US005824265A

United States Patent [19]

Dodd

[11] Patent Number: 5,824,265

[45] Date of Patent: Oct. 20, 1998

[54] STAINLESS STEEL ALLOY FOR PULP REFINER PLATE

[75] Inventor: John Dodd, Arvada, Colo.

[73] Assignee: J & L Fiber Services, Inc., Waukesha, Wis.

[21] Appl. No.: 637,114

[22] Filed: Apr. 24, 1996

[51] Int. Cl.[6] ..... C22C 38/42; C22C 38/48; C21D 9/00

[52] U.S. Cl. ..... 420/60; 420/61; 148/607; 148/605; 148/326

[58] Field of Search ..... 420/60, 61; 158/326, 158/607, 605

[56] References Cited

U.S. PATENT DOCUMENTS

| | | | |
|---|---|---|---|
| 2,784,125 | 3/1957 | Clarke, Jr. | 148/326 |
| 2,905,577 | 9/1959 | Harris et al. | 148/326 |
| 3,840,366 | 10/1974 | Hirayama et al. | 148/326 |
| 4,049,430 | 9/1977 | Myers . | |
| 5,165,592 | 11/1992 | Wasikowski | 228/195 |
| 5,230,752 | 7/1993 | Bourgain et al. | 148/325 |
| 5,232,520 | 8/1993 | Oka et al. | 148/542 |
| 5,257,453 | 11/1993 | Neumann et al. | 29/888.4 |
| 5,344,502 | 9/1994 | Mack et al. | 148/236 |
| 5,370,750 | 12/1994 | Novotny et al. | 148/325 |

FOREIGN PATENT DOCUMENTS

| | | |
|---|---|---|
| 0 257 780 A | 3/1988 | European Pat. Off. . |
| 0603402 A1 | 2/1993 | European Pat. Off. . |
| 0606885 A1 | 1/1994 | European Pat. Off. . |
| 0 625 586 A | 11/1994 | European Pat. Off. . |
| 63-004045 | 1/1988 | Japan . |
| 01100246 | 4/1989 | Japan . |
| 2265154 | 2/1992 | United Kingdom . |
| WO 92/11941 | 7/1992 | WIPO . |

*Primary Examiner*—Deborah Yee
*Attorney, Agent, or Firm*—Nilles & Nilles, S.C.

[57] ABSTRACT

A refiner disk or disk segment is cast from a stainless steel alloy having a composition of 0.2 percent to 0.4 percent carbon, 0.5 to 1.5 percent manganese, 0.5 percent to 1.5 percent silicon, a maximum of 0.05 percent sulfur, a maximum of 0.05 percent phosphorus, 14 percent to 18 percent chromium, 2 percent to 5 percent nickel, 2 percent to 5 percent copper, a maximum of 1 percent molybdenum, and 1.5 percent to 2.5 percent niobium, the balance being iron. The Niobium forms discrete carbides at high temperatures during the melting process. Upon cooling, the carbides are distributed evenly throughout the structure. This resultant alloy provides toughness and corrosion resistance like a lower carbon alloy plus increased wear resistance due to the carbide formation. The alloy utilizes chromium to impart corrosion resistance, the process of tying up carbon as discrete, non-chromium carbides increases the amount of chromium present to provide corrosion resistance.

10 Claims, 3 Drawing Sheets

STAINLESS STEEL ALLOY FOR PULP REFINER PLATE

FIELD OF THE INVENTION

This invention relates in general to refiners for treating paper pulp fibers to place the fibers in the desired condition prior to being delivered to a papermaking machine, and relates in particular to metal alloys used for manufacturing refiner plates.

BACKGROUND OF THE INVENTION

Disc refiners are used in the papermaking industry to prepare paper pulp fibers for the forming of paper on a papermaking machine.

Paper stock containing two to five percent dry weight fibers is fed between closely opposed rotating discs within the refiner. The refiner discs perform an abrading operation on the paper fibers as they transit radially between the opposed moving and non-moving refiner discs. The purpose of a disc refiner is to abrade the individual wood pulp fibers. A necessary corollary to that action is that a certain amount of abrasive wear of the refiner plates must occur.

Processing of fibers in a low consistency refiner may be performed on both chemically and mechanically refined pulps and in particular may be used sequentially with a high consistency refiner to further process the fibers after they have been separated in the high consistency disk refiner. In operation, a low consistency disc refiner is generally considered to exert a type of abrasive action upon individual fibers in the pulp mass so that the outermost layers of the individual cigar-shaped fibers are frayed. This fraying of the fibers, which is considered to increase the freeness of the fibers, facilitates the bonding of the fibers when they are made into paper.

Paper fibers are relatively slender, tube-like structural components made up of a number of concentric layers. Each of these layers (called "lamellae") consists of finer structural components (called "fibrils") which are helically wound and bound to one another to form the cylindrical lamellae. The lamellae are in turn bound to each other, thus forming a composite which, in accordance with the laws of mechanics, has distinct bending and torsional rigidity characteristics. A relatively hard outer sheath (called the "primary wall") encases the lamellae. The primary wall is often partially removed during the pulping process. The raw fibers are relatively stiff and have relatively low surface area when the primary wall is intact, and thus exhibit poor bond formation and limited strength in the paper formed with raw fibers.

It is generally accepted that it is the purpose of a pulp stock refiner, which is essentially a milling device, to partially remove the primary wall and break the bonds between the fibrils of the outer layers to yield a frayed surface, thereby increasing the surface area of the fiber multi-fold.

Disc refiners typically consist of a pattern of raised bars interspaced with grooves. Paper fibers contained in a water stock are caused to flow between opposed refiner discs which are rotating with respect to each other. As the stock flows radially outwardly across the refiner plates, the fibers are forced to flow over the bars. The milling action is thought to take place between the closely spaced bars on opposed discs. It is known that sharp bar edges promote fiber stapling and fibrillation due to fiber-to-fiber action. To achieve this, an advantageous method of fabricating bars which wear sharp has been utilized in the construction of refiner plates such as disclosed in U.S. Pat. No. 5,165,592 to Wasikowski. It is also known that dull bar edges result in fiber cutting by fiber-to-bar action.

Thus the material from which refiner disks are made should have high wear resistance. Wear resistance is typically associated with hard brittle materials, for example metal carbides. Refiner plates are subject to a corrosive environment. The pulp fibers are often contained in a stock which is acidic or basic as a result of the chemical processes used to free the wood fibers from the lignin which binds the fibers together in unprocessed wood. In addition to abrasive wear and corrosion, refiner plates can be subjected to impact loading as a result of opposed plates coming into contact or a foreign object impacting the plates. Failure of the plate due to lack of toughness can not only result in the destruction of the disk refiner but can damage downstream equipment.

A conflict is created by the need for both toughness and wear resistance in refiner plate materials which is further complicated by the need for good corrosion resistance. Low carbon stainless steel materials are normally used in refiner plate applications that require toughness. The properties of these stainless steel alloys are greatly influenced by carbon. Very low carbon levels are required to develop the excellent toughness and corrosion resistance that make stainless steels effective as refiner plate materials. Low carbon content, however, also translates into low hardness levels and poor resistance to abrasive wear. It has been a constant dilemma trying to improve these properties without greatly affecting the material's ability to resist breakage.

SUMMARY OF THE INVENTION

A refiner disk or disk segment is cast from a stainless steel alloy having a composition of 0.2 percent to 0.4 percent carbon, 0.5 to 1.5 percent manganese, 0.5 percent to 1.5 percent silicon, a maximum of 0.05 percent sulfur, a maximum of 0.05 percent phosphorus, 14 percent to 18 percent chromium, 2 percent to 5 percent nickel, 2 percent to 5 percent copper, a maximum of 1 percent molybdenum, and 1.5 percent to 2.5 percent niobium, the balance being iron.

The niobium forms discrete carbides at high temperatures during the melting process. Upon cooling, the carbides are distributed evenly throughout the structure. This resultant alloy provides toughness and corrosion resistance like a lower carbon alloy plus increased wear resistance due to the carbide formation. The alloy utilizes chromium to impart corrosion resistance. The process of tying up carbon as discrete, non-chromium carbides increases the amount of chromium present to provide corrosion resistance.

The refiner disk or disk segment is soaked at a temperature of 1,600 degrees Fahrenheit to 1,800 degrees Fahrenheit for three to five hours. After high temperature soaking the refiner disk segment is air cooled with fans until it reaches room temperature. The disk segment is then age hardened at 900 to 1,050 degrees Fahrenheit for three to five hours to increase the disk's hardness.

A refiner disk formed of the disclosed composition and treated as suggested has a toughness comparable to a conventional alloy, together with slightly enhanced corrosion resistance and significantly improved abrasion resistance.

It is a feature of the present invention to provide a refiner disk of improved abrasion resistance.

It is another feature of the present invention to provide a new alloy for use in applications for machines for processing paper pulp fibers.

It is a further feature of the present invention to provide a method of treating a cast article of a particular alloy to maximize the toughness and abrasion resistance of a component fabricated of the particular alloy.

Further objects, features and advantages of the invention will be apparent from the following detailed description when taken in conjunction with the accompanying drawings.

DESCRIPTION OF THE PREFERRED EMBODIMENT

Figure 1:
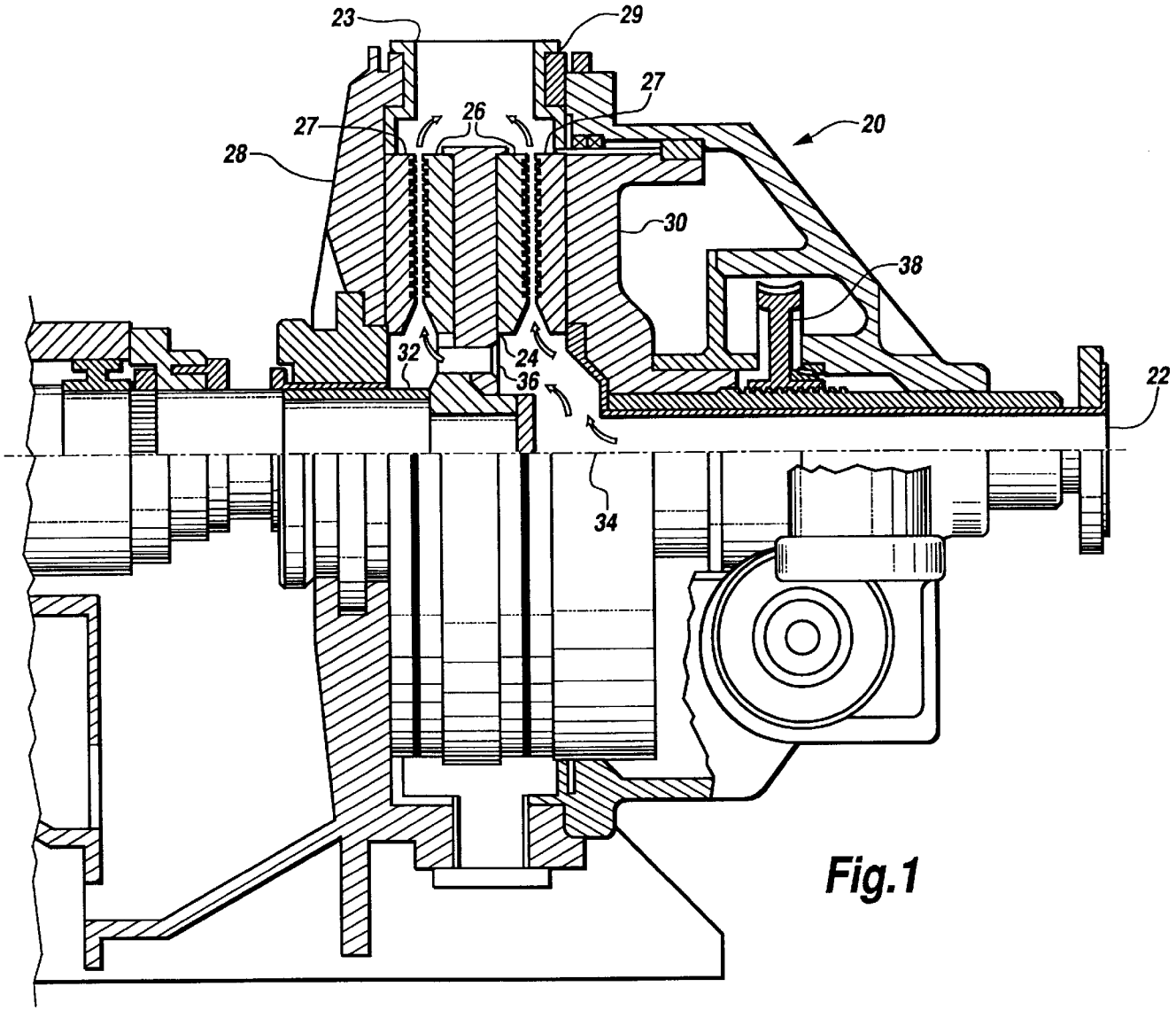
FIG. 1 is a side-elevational view, partly cut away, of a low consistency disc refiner.
Figure 2:
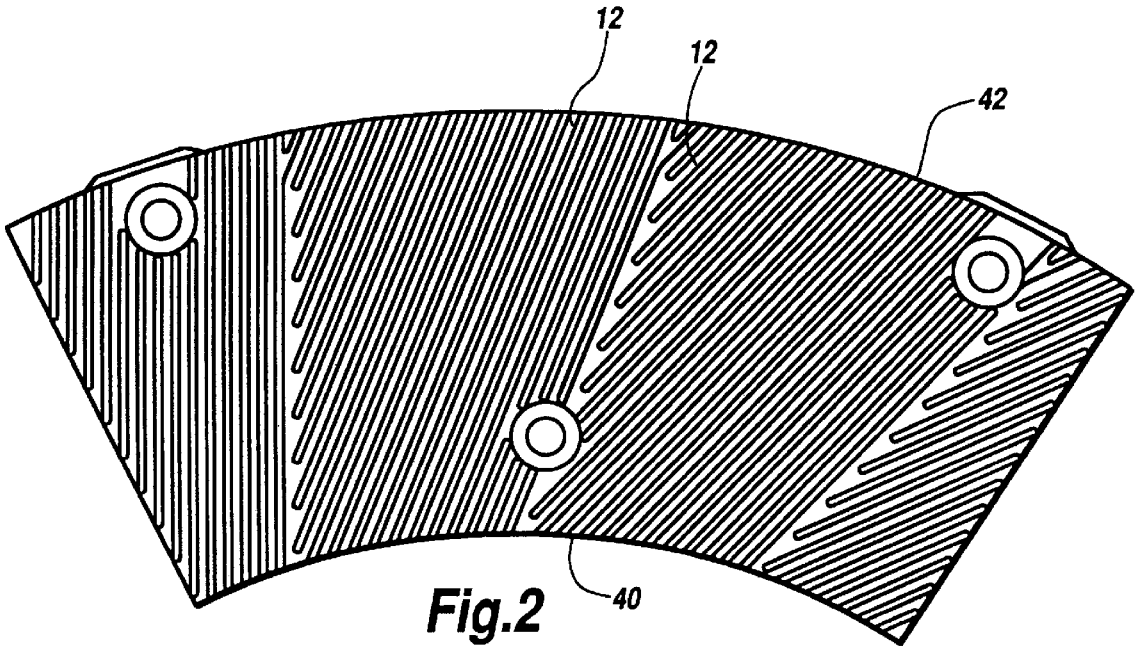
FIG. 2 is a segment of a disc refiner plate of this invention.
Figure 3:
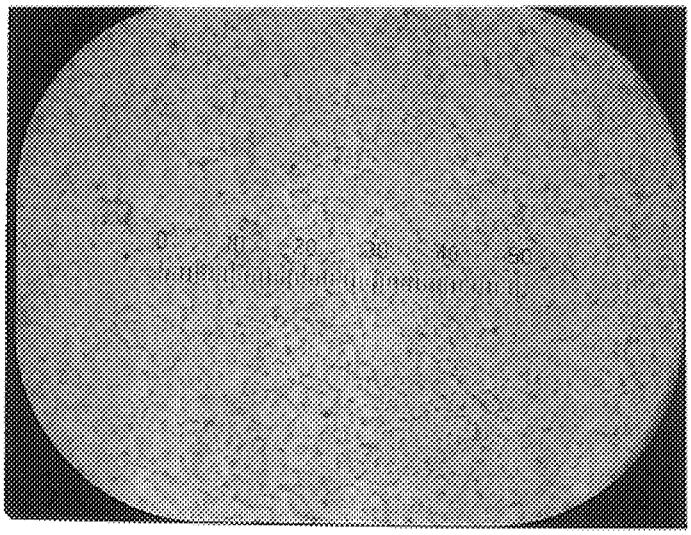
FIG. 3 is a photomicrograph showing a 100X enlargement of a polished etched as cast sample of the alloy of this invention.
Figure 4:
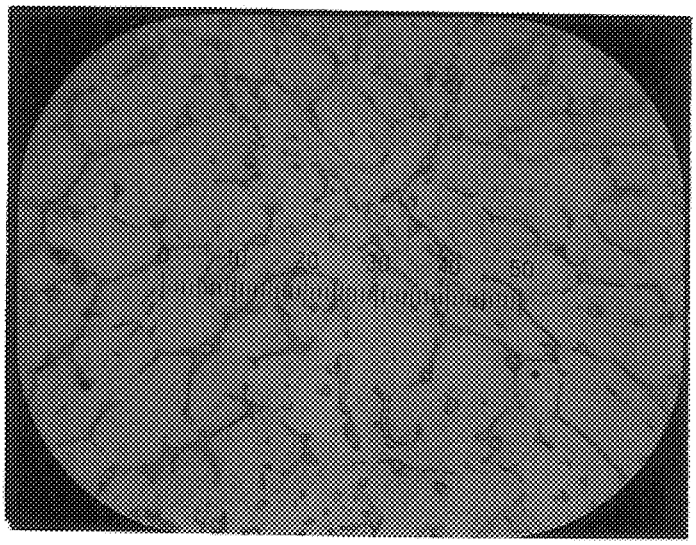
FIG. 4 is a photomicrograph showing a 400X enlargement of a polished etched as cast sample of the alloy of this invention.

Referring more particularly to FIGS. 1–5 wherein like numbers refer to similar parts, the crystal structure of a stainless steel alloy particularly useful in the fabrication of refiner plates 26 is shown in FIGS. 3 and 4. The alloy hereinafter referred to as EX05 has the chemical composition as shown in Table 1 with the balance of the alloy consisting of iron with incidental impurities.

TABLE 1

Chemical Composition of EX05

| Element | Percent by weight |
|---|---|
| C | 0.20–0.40 |
| Mn | 0.5–1.5 |
| Si | 0.5–1.5 |
| S | 0.05 max |
| P | 0.05 max |
| Cr | 14–18 |
| Ni | 2.0–5.0 |
| Cu | 2.0–4.0 |
| Mo | 1.0 max |
| Nb | 1.5–2.5 |

Known stainless steel alloys used in the formation of refiner plates (see for example Table 2 showing the chemistry for 17-4PH) have a low carbon content in order to achieve high toughness and corrosion resistance. But, the low carbon content results in a material having a low hardness level and poor resistance to abrasive wear.

TABLE 2

Typical chemistries for 17-4PH

| alloy | C | Mn | Si | S | P | Cr | Ni | Cu | Mo | Nb |
|---|---|---|---|---|---|---|---|---|---|---|
| 17-4PH | .07 | .60 | .70 | .03 | .04 | 16.0 | 4.0 | 2.8 | .10 | .30 |

The carbon content in stainless steels influences both the matrix microstructure and the formation of carbides. Stainless steels can be composed of three basic crystalline phases of iron: Austenite has a face centered cubic structure known as gamma iron, is produced by alloying iron with substantial amounts of nickel, and is stable at high temperatures. Ferrite has a body-centered cubic structure and in stainless steel is an alloy of iron containing more than 12 percent chromium. Lastly, martensite is a metastable form of iron formed by rapid cooling of iron containing a sufficient amount of carbon. The amount of carbon available within a steel composition strongly influences the crystal form which results when a melt is cooled. The presence of carbon also influences the crystal structure which can be developed through heat-treating a particular alloy. High toughness is achieved with very low carbon content which produces ferritic stainless steel.

If the carbon content of stainless steel is increased the carbon tends to form carbides with the other elements present in the alloy. Chromium which is added to stainless steel for corrosion resistance tends to form carbides or eutectic carbides, which form at the grain or crystal boundaries within the metal matrix if sufficient carbon is present. The carbides at the grain boundaries weaken the structure formed by the metal making it susceptible to mechanical failure.

The formation of carbides by the interaction of the carbon and chromium present in the stainless steel tends to reduce corrosion resistance by locally depleting chromium where the grain boundary carbides are formed.

Metal carbides are materials of high hardness and thus impart abrasion resistance when contained by a stainless steel alloy. Thus carbides are desirable if a way can be found to prevent their reducing the toughness of the stainless steel. It has long been known to add small amounts of niobium—also known as columbium by metallurgists—to certain grades of stainless steel to improve weldability by preventing embrittlement of the weld zone. Niobium forms a carbide at high temperatures and thus removes the carbon from effective interaction with the other constituents of the alloy, in effect making the carbon unavailable. Thus if the amount of niobium and carbon are both increased dramatically the detrimental effects of adding carbon to the stainless steel are prevented while at the same time the wear resistance of the alloy used is dramatically improved by the formation of distributed niobium carbides.

One very important feature of the alloy is that by adding carbon the fluidity of the melt is increased. Fluidity is important in being able to cast the detailed bars 12 of the refiner plate segment shown in FIG. 2. For example in the casting of one refiner segment using a low carbon alloy 5.5 percent of the castings were defective due to miss-run, the low carbon alloy failed to fill the mold and thus failed to completely form the refiner bars, due to a lack of fluidity of the casting alloy. When a test run of the same parts was cast with the EX05 alloy there were no defects attributable to miss-run or the lack of fluidity. Carbon normally increases fluidity but results in a brittle alloy. The addition of niobium prevents the increased carbon content from forming embrittling carbides. At casting temperatures the carbon is available to increase the fluidity of the melt. After casting the niobium carbide precipitates at very high temperatures and is therefore evenly distributed throughout the cast article. This early formation of niobium carbide also advantageously reduces the carbon available to precipitate from the eutectic materials late in cooling, reducing the formation of metal carbides at the crystal grain boundaries which would tend to embrittle the alloy formed.

Table 3 shows the relative toughness, abrasion resistance, and corrosion resistance of both the existing alloy 17-4PH alloy and the EX05 alloy containing 0.28 percent carbon, 1.5 percent manganese, 1 percent silicon, a maximum of 0.05 percent sulfur, a maximum of 0.05 percent phosphorus, 16.5 percent chromium, 3.5 percent nickel, 3 percent copper, a maximum of about 1 percent molybdenum, and 2 percent niobium, the balance essentially iron with incidental impurities.

TABLE 3

| Properties for 17-4PH and EX05 | | | |
|---|---|---|---|
| alloy | toughness, lbs | abrasion, gm | corrosion, gm |
| EX05 | 22,000 | 0.43 | 0.29 |
| 17-4PH | 34,000 | 0.62 | 0.31 |

The EX05 alloy has comparable toughness, slightly improved corrosion resistance, and over 50 percent improved abrasion resistance compared to a typical stainless steel used in refiner plates.

Referring to FIG. 4, the structure shown by a polish etched but not heat treated sample of the EX05 alloy includes major gray areas of the photo which are martensite and some retained austenite. The niobium carbide are the small discrete distributed grains having a generally triangular or polygonal shape. The somewhat dendritic linear features of the photomicrographs of FIGS. 3 and 4 are delta ferrite materials.

A refiner plate segment 42, as shown in FIG. 2, is a typical structure which can be formed from EX05. The segment 42 is cast of the EX05 alloy using one of the more modern sand casting methods which employs a fine grain sand with an organic binder. Such a process can produce features more precisely than a typical green sand casting providing the casting metal has sufficient fluidity. The disk plate segment 42 thus formed is soaked at a temperature of 1,600 degrees Fahrenheit to 1,800 degrees Fahrenheit for three to five hours. After high temperature soaking the refiner disk segment 42 is air cooled with fans until it reaches room temperature. The disk segment 42 is then age hardened at 900 to 1,050 degrees Fahrenheit for three to five hours to increase the disk's hardness.

Figure 5:
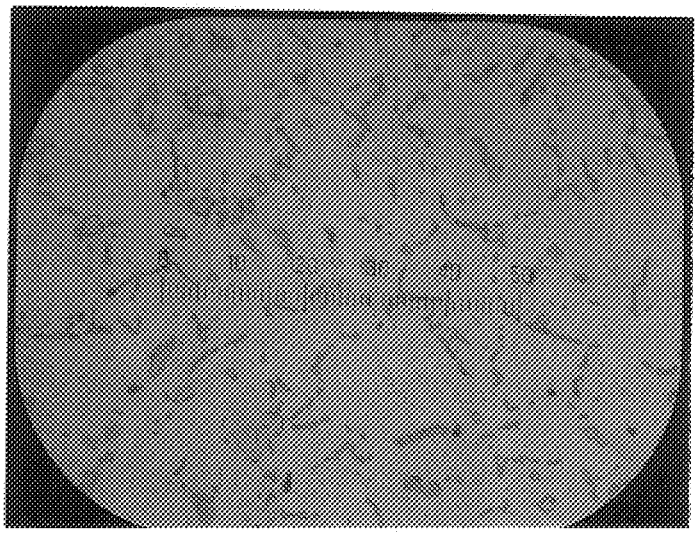
FIG. 5 is a photomicrograph showing a 400X enlargement of a polished etched heat treated sample of the alloy of this invention.

FIG. 5 shows the structure of the EX05 alloy after it has been heat soaked and precipitation hardened. The structure shown by a polish etched and heat treated sample of the EX05 alloy includes major gray areas of the photo which are martensite and some retained austenite. The niobium carbide grains are somewhat larger as a result of the heat treating but are still discrete and still have a generally triangular or polygonal shape. The somewhat less dendritic linear features of the photomicrograph of FIG. 5 are delta ferrite materials. Heat treating the EX05 alloy increases its Rockwell hardness (Rc) from approximately thirty-five in the as cast condition to about 42 Rc after heat treating. The heat treating, as shown by the differences between FIG. 4 and FIG. 5 improves the grain structure at the same time hardness is increased. The niobium carbide granules are increased in size by precipitation hardening which allows the niobium carbide grains to grow in size. The high temperature soaking serves to better distribute the carbon within the alloy but is not essential to the precipitation hardening.

The segment 42 has bars 12 which form passageways 40 through which stock containing fibers is caused to flow. The refiner plates are used to refine fibers in a disc refiner 20.

The disc refiner 20, as shown in FIG. 1, has a housing 29 with a stock inlet 22 through which papermaking stock, consisting of two to five percent fiber dry-weight dispersed in water, is pumped, typically at a pressure of 20 to 40 psi. Refiner plates 26 are mounted on a rotor 24. Refiner plates 27 are also mounted to a non-moving head 28 and to a sliding head 30. The refiner plates 27 which are mounted to the non-moving head 28 and the sliding head 30 are opposed and closely spaced from the refiner plates 26 on the rotor 24.

The rotor 24 is mounted to a shaft 32. The shaft 32 is mounted so the rotor 24 may be moved axially along the axis 34 of the shaft. The rotor has passageways 36 which allow a portion of the stock to flow through the rotor 24 and pass between the refiner plates 26, 27 which are opposed between the rotor and the stationary head 28. A portion of the stock also passes between the refiner plates 26 mounted on the rotor and the refiner plates 27 mounted on the sliding head 30. After being refined by the rotor the stock leaves the housing 29 through an outlet 23.

In operation, the gaps between the refiner plates 26 mounted on the rotor 24, and the refiner plates 27 mounted on the non-rotating heads 28 and 30, are typically three to eight thousandths of an inch. The dimensions of the gaps between the refiner plates 26, 27 are controlled by positioning the rotor between the non-moving head 28 and the sliding head 30. Stock is then fed to the refiner 20 and passes between the rotating and non-rotating refiner plates 26, 27 establishing hydrodynamic forces between the rotating and non-rotating refiner plates. The rotor is then released so that it is free to move axially along the axis 34 by means of a slidable shaft 32.

The rotor 24 seeks a hydrodynamic equilibrium between the non-rotating head 28 and the sliding head 30. The sliding head 30 is rendered adjustable by a gear mechanism 38 which slides the sliding head 30 towards the stationary head 28. The hydrodynamic forces of the stock moving between the stationary and the rotating refiner plates 26, 27 keeps the rotor centered between the stationary head 28 and the sliding head 30, thus ensuring a uniform, closely spaced gap between the stationary and rotating refiner plates 26, 27. The close spacing between the refiner plates 26, 27 presents the possibility that the plates will occasionally collide or a foreign object will become jammed between the plates. In such circumstances the ductility of the EX05 alloy reduces the possibility of failure of the plates. At the same time the EX05 alloy tends to be wear resistant, thereby increasing the lifetime of the refiner disks.

The longer life of the disks 26, 27 helps to lower the cost of operating the refiner 20. Long life results in fewer disks being used up but also saves costs through reduced down time necessary to replace worn disks.

In a disk refiner 20 the refining action is thought to take place along the edges of the bars 12 on the disks 26, 27. To the extent the niobium carbide grain in the metal from which the refiner plates are fabricated causes the bar edges to wear rough, the bar edges will hold the fibers on the edges and increase the amount of refining which takes place as the fibers pass through the refiner 20.

Because the niobium carbide grain increases the wear resistance by presenting distributed grain of high hardness material in a matrix of softer tougher material it is expected that the grains will tend to stand out from the surface of the bar as the softer matrix is worn away from between the niobium carbide grains. This wear pattern produces a rough surface along the bar edges. A rough wearing surface can be particularly effective in promoting fiber stapling and fibrillation due to fiber-to-fiber action between opposed refiner plates. Wear resistance of the edges of the refiner bars 12 is beneficial in keeping the edges sharp—not so the bars can cut the fibers but so the fibers are held on the edges where the refining action takes place.

It should be understood that refiner plates or segments could be produced by various casting techniques including green sand casting and techniques using dry or baked molds.

It is understood that the invention is not limited to the particular construction and arrangement of parts herein illustrated and described, but embraces such modified forms thereof as come within the scope of the following claims.

I claim:

1. A portion of an apparatus for processing papermaking fibers comprising a refiner disk having a composition consisting essentially of from about 0.2 percent to about 0.4 percent carbon, from about 0.5 to about 1.5 percent manganese, about 0.5 percent to about 1.5 percent silicon, a maximum of 0.05 percent sulfur, a maximum of 0.05 percent phosphorus, from about 14 percent to about 18 percent chromium, from about 2 percent to about 5 percent nickel, from about 2 percent to about 5 percent copper, a maximum of about 1 percent molybdenum, and from about 1.5 percent to about 2.5 percent niobium, the balance essentially iron with incidental impurities.

2. The portion of the apparatus of claim 1 wherein the refiner disk has a composition consisting essentially of about 0.28 percent carbon, about 1.5 percent manganese, about 1 percent silicon, a maximum of 0.05 percent sulfur, a maximum of 0.05 percent phosphorus, about 16.5 percent chromium, about 3.5 percent nickel, about 3 percent copper, a maximum of about 1 percent molybdenum, and about 2 percent niobium, the balance essentially iron with incidental impurities.

3. A cast component of an apparatus for processing papermaking fibers comprising a metallic portion having a composition consisting essentially of from about 0.2 percent to about 0.4 percent carbon, from about 0.5 to about 1.5 percent manganese, about 0.5 percent to about 1.5 percent silicon, a maximum of 0.05 percent sulfur, a maximum of 0.05 percent phosphorus, from about 14 percent to about 18 percent chromium, from about 2 percent to about 5 percent nickel, from about 2 percent to about 5 percent copper, a maximum of about 1 percent molybdenum, and from about 1.5 percent to about 2.5 percent niobium, the balance essentially iron with incidental impurities; and having a microstructure as cast of martensite and delta ferrite materials and some retained austenite with triangular or polygonal-shaped niobium carbides as shown in FIG. 4 when enlarged 400 times.

4. The cast component of claim 3 wherein the metallic portion has a composition consisting essentially of about 0.28 percent carbon, about 1.5 percent manganese, about 1 percent silicon, a maximum of 0.05 percent sulfur, a maximum of 0.05 percent phosphorus, about 16.5 percent chromium, about 3.5 percent nickel, about 3 percent copper, a maximum of about 1 percent molybdenum, and about 2 percent niobium, the balance essentially iron with incidental impurities.

5. A cast component of an apparatus for processing papermaking fibers comprising a metallic portion having a composition consisting essentially of from about 0.2 percent to about 0.4 percent carbon, from about 0.5 to about 1.5 percent manganese, about 0.5 percent to about 1.5 percent silicon, a maximum of 0.05 percent sulfur, a maximum of 0.05 percent phosphorus, from about 14 percent to about 18 percent chromium, from about 2 percent to about 5 percent nickel, from about 2 percent to about 5 percent copper, a maximum of about 1 percent molybdenum, and from about 1.5 percent to about 2.5 percent niobium, the balance essentially iron with incidental impurities; and having a microstructure after heat treating of martensite and delta ferrite materials and some retained austenite with triangular or polygonal-shaped niobium carbides as shown in FIG. 5 pastel when enlarged 400 times.

6. The cast component of claim 5 wherein the metallic portion has a composition consisting essentially of about 0.28 percent carbon, about 1.5 percent manganese, about 1 percent silicon, a maximum of 1.05 percent sulfur, a maximum of 0.05 percent phosphorus, about 16.5 percent chromium, about 3.5 percent nickel, about 3 percent copper, a maximum of about 1 percent molybdenum, and about 2 percent niobium, the balance essentially iron with incidental impurities.

7. A method of making at least a part of a disk for use in a refiner for processing papermaking fibers, the method comprising the steps of:

melting a quantity of metal having a composition consisting essentially of from about 0.2 percent to about 0.4 percent carbon, from about 0.5 to about 1.5 percent manganese, about 0.5 percent to about 1.5 percent silicon, a maximum of 0.05 percent sulfur, a maximum of 0.05 percent phosphorus, from about 14 percent to about 18 percent chromium, from about 2 percent to about 5 percent nickel, from about 2 percent to about 5 percent copper, a maximum of about 1 percent molybdenum, and from about 1.5 percent to about 2.5 percent niobium, the balance essentially iron with incidental impurities; and forming a casting of at least a part of a disk for use in a refiner.

8. The method of claim 7 further comprising the steps of:

soaking the casting at a temperature of about 1600 to about 1800 degrees Fahrenheit; and then rapid air quenching the casting to room temperature.

9. The method of claim 7 further comprising the step of age hardening the casting at a temperature of 900 to about 1050 degrees Fahrenheit to increase the size of the niobium carbide grains within the casting.

10. The method of claim 7 wherein the quantity of metal has a composition consisting essentially of about 0.28 percent carbon, about 1.5 percent manganese, about 1 percent silicon, a maximum of 0.05 percent sulfur, a maximum of 0.05 percent phosphorus, about 16.5 percent chromium, about 3.5 percent nickel, about 3 percent copper, a maximum of about 1 percent molybdenum, and about 2 percent niobium, the balance essentially iron with incidental impurities.

* * * * *